US006074287A

United States Patent [19]

Miyaji et al.

[11] Patent Number: 6,074,287

[45] Date of Patent: Jun. 13, 2000

[54] SEMICONDUCTOR WAFER POLISHING APPARATUS

[75] Inventors: Akira Miyaji, Tokyo; Takashi Arai, Saitama-ken; Takeshi Yagi, Yokohama, all of Japan

[73] Assignee: Nikon Corporation, Tokyo, Japan

[21] Appl. No.: 08/834,665

[22] Filed: Apr. 11, 1997

[30] Foreign Application Priority Data

| | | | |
|---|---|---|---|
| Apr. 12, 1996 | [JP] | Japan | 8-115794 |
| Jul. 17, 1996 | [JP] | Japan | 8-187378 |
| Jul. 17, 1996 | [JP] | Japan | 8-187380 |
| Oct. 19, 1996 | [JP] | Japan | 8-297499 |

[51] Int. Cl.[7] ..... B24B 7/22

[52] U.S. Cl. ..... 451/287; 451/533; 451/6

[58] Field of Search ..... 451/41, 6, 288, 451/287, 533, 534, 530, 290

[56] References Cited

U.S. PATENT DOCUMENTS

| | | | |
|---|---|---|---|
| 5,433,651 | 7/1995 | Lustig et al. . | |
| 5,486,129 | 1/1996 | Sandhu et al. | 451/6 |
| 5,564,965 | 10/1996 | Tanaka et al. | 451/287 |
| 5,605,760 | 2/1997 | Roberts | 451/41 |
| 5,609,511 | 3/1997 | Moriyama et al. | 451/8 |
| 5,762,536 | 6/1998 | Pant et al. | 451/6 |

FOREIGN PATENT DOCUMENTS

| | | | |
|---|---|---|---|
| 5309558 | 11/1993 | Japan | 451/290 |

*Primary Examiner*—Robert A. Rose

*Attorney, Agent, or Firm*—Klarquist Sparkman Campbell Leigh & Whinston, LLP

[57] ABSTRACT

Polishing laps and apparatus incorporating such polishing laps for polishing workpieces such as semiconductor wafers are disclosed. The polishing laps are made from a cured mixture of an epoxy resin and a filler material, and preferably have at least a portion that is transparent to light. The polishing lap is preferably mounted on rigid polishing wheel or the like with or without an intervening layer such as an elastic layer. Polishing apparatus incorporating the polishing lap preferably include a light source for directing a beam of light toward the transparent portion of the polishing lap to enable the light beam to reflect from the working surface of the workpiece as the workpiece is being polished by the polishing lap. The apparatus also preferably includes a light detector for detecting light reflected from the surface of the workpiece. Such light can provide information, as on the status of the working surface as polishing progresses and can provide an indication of when polishing has reached a desired end point.

34 Claims, 8 Drawing Sheets

SEMICONDUCTOR WAFER POLISHING APPARATUS

FIELD OF THE INVENTION

The invention concerns polishing apparatus and polishing laps for polishing semiconductor wafers. It further concerns apparatus and methods for determining the state of polish of a semiconductor wafer during polishing.

BACKGROUND OF THE INVENTION

In recent years semiconductor device fabrication has become complex, involving increasing numbers of process steps. In addition, the individual process steps themselves have become more complex, including processes that provide for multi-layer interconnections.

Not only is semiconductor device fabrication becoming more complex, but also semiconductor device feature sizes are becoming smaller and smaller. Circuit patterns for semiconductor devices are generally formed on the surface of the wafer using high-resolution optical systems. Such high-resolution optical systems frequently use short-wavelength light and high numerical aperture optics. In such high-resolution optical systems, the depth of focus of the optical system is small and wafer surface irregularities cause errors in the projected patterns. Therefore, the accurate transfer of circuit patterns to a semiconductor wafer requires that the wafer surface be flat.

Providing a flat surface to a wafer or similar type of workpiece is challenging. The required degree of flatness can be less than a fraction of a wavelength of light. Wafers generally have large cross-sections and small thicknesses and accordingly are not mechanically stiff. Therefore, the flatness of a wafer surface is easily disturbed by even small forces applied to the wafer.

Flatness errors associated with the small thickness of the wafer tend to produce local curvature of the wafer surface and variations in wafer thickness. The flatness errors associated with wafer curvature tend to be gradual, extending distances across the wafer surface that are greater than the wafer thickness.

Other flatness errors are possible as well. Some advanced fabrication processes alter the surface of the semiconductor wafer so that the wafer surface is not flat, even if the surface was flat before fabrication began. For example, the deposition of a conducting or insulating strip on the wafer surface creates a vertical step in the wafer surface. The vertical step causes defects in subsequent fabrication steps. For example, a conducting layer that crosses a vertical step can suffer a vertical break, resulting in a large increase in resistance, an open circuit, or reduced current capacity. An insulating layer on top of a vertical step can have reduced resistance, permitting increased leakage currents. To prevent these defects, a flat wafer surface must be maintained during processing.

FIGS. 14(*a*), 14(*b*), and 14(*c*) show typical flatness errors and the correction of these errors with respect to wafers and similar workpieces; the flatness errors of FIG. 14 are typical of flatness errors that result from wafer processing. FIG. 14(*a*) shows the correction of a flatness error resulting from deposition of an insulating layer 401 on a wafer. The insulating layer 401 is typically borophosphosilicate glass (BPSG), tetraethylorthosilicate-silicon dioxide (TEOS-$SiO_2$)), or another insulating material. FIG. 14(*b*) shows the correction of a flatness error near a conductor layer 402 that connects to other layers. Portions of the conductor layer 402 are removed, flattening the surface. Typical conducting layers are metallic layers of tungsten, aluminum, or copper. FIG. 14(*c*) shows the removal of excess metal in a conducting layer 403 associated with an embedded conductor (Damascene Process).

Flatness errors such as those of FIGS. 14(*a*)–(*c*) are conventionally removed using a chemical-mechanical polishing or chemical-mechanical planarization technique ("CMP"). FIG. 15 shows a conventional semiconductor polishing apparatus for semiconductor wafers using the CMP technique. FIGS. 15(*a*) and 15(*b*) are a side elevational view and plan view, respectively, of the semiconductor polishing apparatus.

The polishing apparatus of FIGS. 15(*a*)–15(*b*) has a polishing pad 200 fixed to a polishing wheel 100. A wafer carrier 301 holds a wafer 300 and a pressure mechanism (not shown in the figure) applies a pressure 110 that forces the wafer carrier 301 and the wafer 300 against the polishing pad 200. The polishing wheel 100 rotates while a polishing slurry 202 drips from a dispenser 201. The wafer carrier 301 both rotates about its axis and slides across the polishing pad 200, thereby polishing the surface of the wafer 300. The polishing pad 200 is typically a felt sheet with a two-layer structure consisting of a lower layer of non-woven cloth and an upper layer of a micro-porous polyurethane foam.

Various methods have been used for determining the state of polish of the wafer 300 and thereby determining when to stop polishing. The state of polish of the wafer 300 at which polishing should stop is called the endpoint. Methods for controlling attainment of the endpoint include controlling the polishing time, detecting changes in the torque required to rotate the wafer carrier 301 (typically by measuring the electric current drawn by the motor that rotates the wafer carrier 301), and detecting changes in the frictional sound caused by polishing.

Optical methods of endpoint detection have also been used. In conventional optical endpoint detection, holes are provided in the table 100 and the polishing pad 200, through which holes a laser beam irradiates the wafer 300. A portion of the laser beam is reflected by the wafer 300; the reflected light is detected and used to assess the state of polish of the wafer 300.

The CMP technique has various drawbacks. CMP polishing tends to over-polish the edges of the wafer 300. The wafer 300 is frequently deformed when pressure is applied to the wafer 300 during polishing. Particles and other irregularities in the adhesive layer binding the polishing pad 200 to the polishing wheel 100 cause additional wafer deformations. The polishing pad 200 tends to clog and therefore the polishing pad 200 must be dressed or ground frequently if it is to continue polishing effectively. The polishing pad 200 tends to wear out, requiring frequent replacement. As a result, the CMP technique using the polishing pad 200 is generally unable to polish the wafer 300 as smooth and flat as required. In addition, the polishing pad 200 requires frequent dressing or replacement during use, slowing wafer processing.

Furthermore, it is difficult to observe and measure the state of polish of the wafer 300 during the polishing process. When conventional optical endpoint detection is used, the required hole in the polishing lap and polishing wheel make achieving wafer flatness even more difficult. Other conventional endpoint-determination methods rely on secondary indicators (e.g., sound or torque) of the state of polish of the wafer 300. Using these methods the wafer 300 is frequently polished excessively or polishing is interrupted before the desired endpoint is reached. Interrupting polishing for inspection only to begin polishing again is inconvenient and slows wafer processing.

Therefore, it is advantageous to determine when to stop polishing ("endpoint detection") during polishing but conventional methods do not reliably permit such endpoint detection.

SUMMARY OF THE INVENTION

This invention provides, inter alia, inexpensive polishing laps that produce a better wafer polish than conventional polishing pads. The polishing laps are thermally stable in that they do not appreciably deform due to heating during polishing. The polishing laps can polish many wafers before requiring dressing or refacing, speeding wafer processing. The polishing laps of the invention produce flat semiconductor wafer surfaces with little edge wear.

It has been found that adhesives that "harden" (i.e., cure) by cross-linking (e.g., "epoxy" adhesives) cure with very little shrinkage, release easily from molds, and have excellent resistance to mechanical wear and chemical deterioration. Polyols such as glycerin have excellent properties as a drying agent and lubricant. Fillers such as graphite, carbon particles, and nylon particles have superior properties of heat resistance, thermal shock resistance, and slipperiness. We have found that these characteristics can be combined to produce effective polishing laps. A mixture of epoxy (typically a two-part epoxy comprising an epoxy resin and a hardener), a filler, and a lubricant (e.g., glycerin) is readily compression-molded and cured to form a polishing lap. The hardnesses of such polishing laps are easily altered by changes in the mixture or in the cure process.

According to another aspect of the invention, polishing laps are provided that have at least a transparent portion. Such polishing laps are especially suitable for optical detection of a polishing endpoint without the need to provide holes in the polishing laps. Such polishing laps are also appropriate for conventional endpoint-detection methods using secondary indicators.

According to yet another aspect of the invention, improved systems and methods for optical endpoint detection using transparent polishing laps are provided. For example, endpoint detection can be done with an apparatus that transmits a laser beam (or other suitable light beam) through the transparent portion of the polishing lap to the "working surface" of the wafer or other workpiece being polished by the polishing lap. The apparatus detects a portion of the laser beam reflected from the working surface. In general, the reflectance of the working surface will change significantly during the polishing process and reflectance is an indicator of the state of polish.

According to yet another aspect of the invention, polishing laps are provided that are transparent not to visible light (i.e., wavelengths between about 400 nm and 700 nm) but rather to longer wavelengths such as infrared wavelengths. Polishing laps that transmit wavelengths between 1–2.5 $\mu$m and 4–6 $\mu$m can use optical endpoint detection with light in these wavelength ranges; such polishing laps permit direct imaging of the wafer surface at these wavelengths. Thus, during the polishing process, the wafer surface can be observed and the state of polish measured.

According to yet another aspect of the invention, polishing laps are provided that comprise two layers in which only the layer that contacts the workpiece during polishing is transparent or has at least a transparent portion. One example of this type of polishing lap comprises a layer of an opaque material (e.g., an epoxy mixture with graphite) having transparent channels extending from the surface that contacts the working surface down into an underlying transparent layer. In these polishing laps, optical endpoint detection can be performed with a laser beam that enters the polishing lap through the underlying transparent layer and exits the polishing lap after one or more reflections from the wafer surface. Of course, this endpoint-detection method can be used with polishing laps according to the invention that comprise completely transparent polishing laps.

Other two-layer polishing laps according to the invention comprise a polishing layer and an underlying elastic layer. The elastic layer permits the polishing lap to conform to the wafer surface while the polishing layer uses the advantageous epoxy mixtures.

The foregoing and other objects, features, and advantages of the invention will become more apparent from the following detailed description of a preferred and multiple example embodiments which proceed with reference to the accompanying drawings.

BRIEF DESCRIPTION OF THE DRAWINGS

FIG. 9(*b*) shows a spiral groove pattern for a polishing lap according to Example Embodiment 10.

FIG. 14(*a*) shows the effects of an insulating layer.

FIG. 14(*b*) shows an interlayer conductor layer. FIG. 14(*c*) shows an intralayer conductor (Damascene Process).

FIG. 15(*b*) shows a wafer in contact with a conventional polishing pad.

DETAILED DESCRIPTION

Figure 1A:
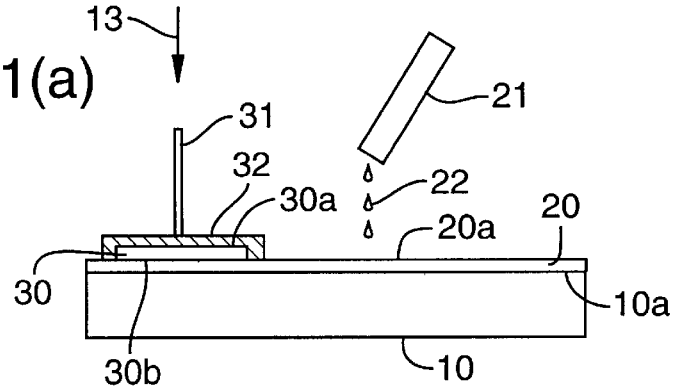
FIGS. 1(*a*)–1(*b*) show a wafer-polishing apparatus, according to the invention, for performing chemical mechanical polishing (CMP), wherein FIG. 1(*a*) is a side elevational view and FIG. 1(*b*) is a plan view.
Figure 1B:
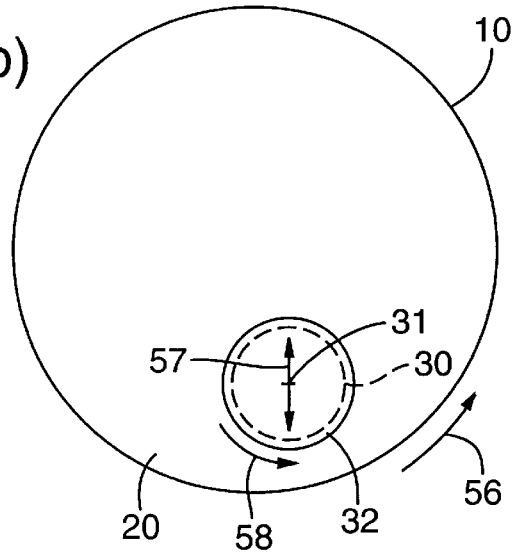

FIG. 1(*a*) shows general features of a wafer-polishing apparatus according to a preferred embodiment of the invention. The apparatus comprises a polishing wheel 10, a polishing lap 20 attached to an upper surface 10*a* (a "major surface") of the polishing wheel 10, a wafer 30, a wafer carrier 32 for the wafer 30, and a dispenser 21 for supplying a polishing slurry 22. The polishing slurry 22 generally comprises a polishing compound (e.g., cerium oxide) mixed with a carrier liquid (e.g., water). The wafer 30 has a top surface 30*a* and a lower surface 30*b*.

The wafer carrier 32 holds the wafer 30 and urges the lower surface 30*b* of the wafer 30 against a polishing surface 20*a* of the polishing lap 20. With reference to FIG. 1(*b*), the polishing lap 20 (and the polishing wheel 10) rotate as indicated by an arrow 56. The wafer carrier 32 is provided with a carrier axis 31 about which the wafer carrier 32 rotates (arrow 58) during polishing; the carrier axis 31 is approximately perpendicular to the top surface 30*a* and the bottom surface 30*b* of the wafer 30. In addition, the wafer carrier 32 also slides back and forth during polishing as shown by an arrow 57. As a result, the bottom surface 30*b* of the wafer 30 is polished. A load 13 applied to the wafer carrier 32 controls the pressure of the wafer 30 on the polishing surface 20*a*.

Figure 2:
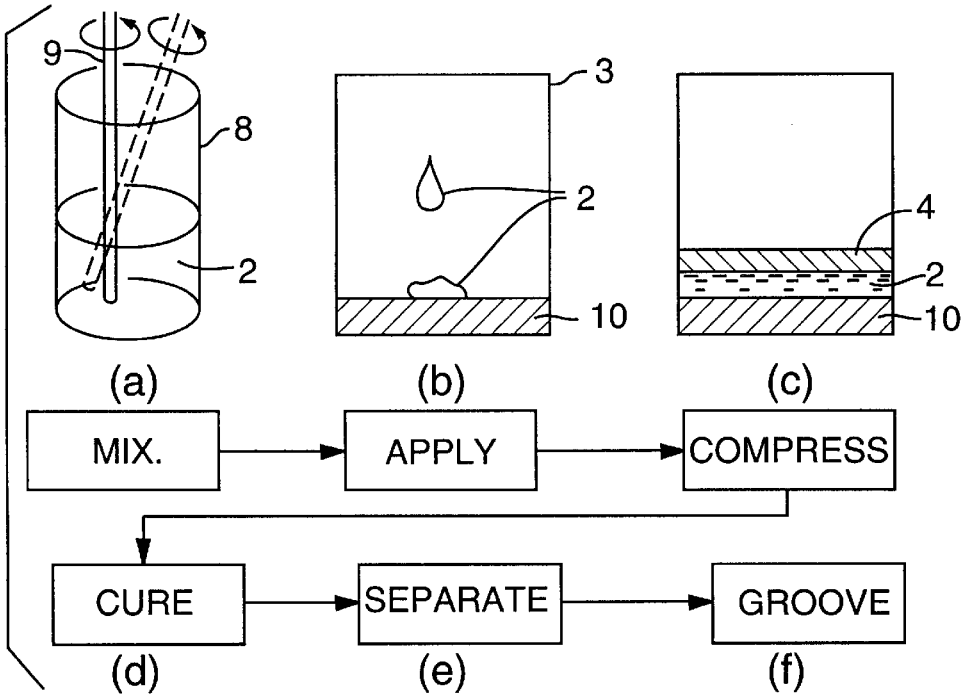
FIGS. 2(*a*)–2(*f*) show steps of a process according to Example Embodiment 1 for making a polishing lap.

The invention provides several example embodiments for the polishing lap 20; FIG. 2 shows a method for making the polishing laps 20 of the example embodiments. The method of FIG. 2 comprises a mixing step, an application step, a dispensing process, and a compression step and is described in detail below in conjunction with Example Embodiment 1.

The polishing laps for wafer polishing can comprise cured epoxy resins and fill materials including, but not limited to, nylon, graphite, and carbon whiskers. The hardness of such polishing laps are readily adjusted to be appropriate for the wafer material to be polished and for maximal hardness stability.

The epoxy resin mixtures preferably further include a lubricant. Addition of a lubricant reduces frictional forces during polishing and can serve to adjust the hardness of the cured epoxy resin mixture. A preferred class of lubricants is polyols, and one especially preferred polyol used in the example embodiments below is glycerin. Polyols also suppress epoxy shrinkage during cure.

Inclusion of graphite, carbon whiskers, carbon particles, nylon, or the like, in the epoxy resin mixtures for the polishing laps decreases the effects of heating on the polishing laps. Thus, the cured epoxy materials have reduced thermal expansion coefficients and reduced friction with the wafer during polishing. Reduced friction produces less frictional heating so that these polishing laps show reduced heating-related effects. In addition, such polishing laps impart less heating to the wafer during polishing.

Each example embodiment uses a particular epoxy resin and hardener; it will be apparent that any of various other epoxies are suitable as well. For purposes of describing the example embodiments, the epoxy used arises from reaction of an epoxy resin with an appropriate curing agent.

The example embodiments are directed to various endpoint-detection methods according to the invention. Some of the example embodiments are also directed to transparent polishing laps that permit optical endpoint detection. In any event, the polishing laps according to this invention can be used with any of various endpoint-detection methods.

The various polishing laps and endpoint-detection methods of the example embodiments were tested by polishing sets of identical sample wafers. The sample wafers were silicon wafers 76.2 mm in diameter and 25 $\mu$m thick. Each sample wafer had a 1 $\mu$m thick silicon dioxide ($SiO_2$) layer deposited on one surface by a vapor-phase growth method such chemical vapor decomposition (CVD). The sample wafers were patterned using a photo-etching process and the patterned wafers were then covered with a 1 $\mu$m layer of aluminum. The sample wafers had a structure similar to that shown in FIG. 14(*b*).

The CMP polishing apparatus disclosed generally in FIG. 1 was used to polish the sample wafers. For testing purposes, 100–200 sample wafers were polished with each example embodiment of the polishing lap 20. Test results are summarized in each example embodiment section below.

EXAMPLE EMBODIMENT 1

The polishing lap 20 of this example embodiment was made of an epoxy ("Bondquick 5," a polythiol epoxy, made by Konishi), glycerin, and graphite. With reference to FIG. 2(*a*), Bondquick 5 resin, curing agent, glycerin, and graphite were mixed in a ratio of 3:1:1:0.05 w/w in a container 8 and stirred with a stirring rod 9 to yield a mixed epoxy resin 2. The hardness of the polishing lap 20 was readily adjusted for various wafer materials by altering the amount of glycerin in the mixed epoxy resin 2.

With reference to FIG. 2(*b*), a polishing wheel 10 of diameter 300 mm is then covered with the mixed epoxy resin 2. In this example embodiment 1, the polishing wheel 10 is made of cast iron, but any of various other materials, such as fused quartz or zeolite, are suitable. A cylindrical sleeve 3 is attached to the polishing wheel 10 so that the polishing wheel 10 forms the bottom of a cylindrical container, the side being formed by the cylindrical sleeve 3. The mixed epoxy resin 2 is applied to the polishing wheel 10 to a prescribed depth. The cylindrical sleeve 3 and the polishing wheel 10 fit together sufficiently snugly that the mixed epoxy resin 2 does not leak at the circumference of the polishing wheel 10.

As shown in FIG. 2(*c*), a compression tool 4, coated with a mold-release agent, is placed on top of the mixed epoxy resin 2 covering the polishing wheel 10. The compression tool 4 compresses and flattens the mixed epoxy resin 2. The thickness of the mixed epoxy resin 2 in this example embodiment is 3 mm. Varying the pressure applied to the compression tool 4 varies the thickness of the resultant polishing lap 20 formed after the epoxy resin cures.

The cylindrical container formed by the polishing wheel 10 and the cylindrical sleeve 3 containing the mixed epoxy resin 2 under compression by the compression tool 4 is next placed in a constant-temperature bath (not shown in FIG. 2), and held at 70° C. for one hour to cure the mixed epoxy resin 2 (FIG. 2(*d*)), and thus form the polishing lap 20. After cooling, the compression tool 4 is removed from the polishing lap 20 (see FIG. 2(*e*)) and the resulting polishing lap 20 is removed from the cylindrical sleeve 3.

Grooves are then cut into the polishing surface 20*a* of the polishing lap 20 (FIG. 2(*f*)). The grooves allow passage of the polishing slurry compound 22; the grooves of the polishing lap are directed radially from the center of the polishing wheel 10.

Using an Oscar-type polishing machine, the polishing lap 20 is "faced" using the compression tool 4 and a polishing slurry containing 5% by weight cerium oxide. Facing smoothes and flattens the surface of the polishing lap 20. After facing, the surface roughness of the polishing lap 20 of this example embodiment is approximately 1 $\mu$m.

The quality of the polish produced on the wafer 30 depends on the quality of polish of the polishing lap 20 which should be very high. Accordingly, using a compression tool 4 with a smooth, flat surface is important. Methods of producing the compression tool 4 include making it as a replica of a high-quality master, precisely polishing the tool surface, or machining the surface of the compression tool 4 using high-precision machining, such as an ultra-high-precision lathe or a diamond turning lathe.

The polishing laps 20 of other example embodiments are made by the same processes of mixing, molding in a cylindrical container with compression by a flat plate, and curing while so molded. The polishing laps 20 are similarly grooved and faced. Particular variations in the processes of FIG. 2 are included with the detailed descriptions of the example embodiments. For convenience in describing the example embodiments, the process of FIG. 2 is hereinafter called the compression-molded and compression-cured ("CMCC") process.

It will be apparent that other curing times and temperatures are appropriate for other specific resin epoxy mixtures.

Sample wafers (25 count) were polished with the polishing lap 20 of this example embodiment according to the polishing parameters of Table 1. After polishing, the top surface 30*a* and the bottom surface 30*b* (FIG. 1(*a*)) of the polished sample wafers were parallel to within 2 to 4 interference fringes (633 nm). The sample wafers showed no edge wear or flatness errors caused by patterns on the sample wafers. The polishing surface 20*a* of the polishing lap 20 appeared unchanged after polishing each wafer and required no additional preparation between wafers to continue polishing the next wafer.

TABLE 1

| Polishing Conditions | |
|---|---|
| polishing wheel rotation | 250 rpm |
| wafer sliding distance | 15 mm |
| wafer sliding rate | 45 roundtrips/minute |
| load | 190 g/cm$^2$ |
| polishing slurry | 6% cerium oxide (w/w) |
| polishing time/wafer | 1 minute |

EXAMPLE EMBODIMENT 2

The polishing lap 20 of this example embodiment was made according to the CMCC method as described above. This example embodiment differs from Example Embodiment 1 in the composition of the epoxy resin mixture 2 and the grooves in the polishing surface 20*a*. In this example embodiment, the epoxy resin mixture 2 was a mixture of "Bondquick 5" epoxy resin, tetraethylenepentamine curing agent, glycerin, and graphite in a ratio of 3:1:0.5:0.5 by weight. A spiral groove was cut into the polishing surface 20*a* (as in FIG. 9(*b*)). The groove was 0.7 mm deep with a 1-mm pitch and a triangular transverse profile.

Sample wafers (25 count) were polished with the polishing lap 20 of this example embodiment 2 using the polishing conditions of Table 1. The top surface 30*a* and the bottom surface 30*b* of the polished sample wafers were parallel to within 2 to 4 interference fringes (633 nm). The polished surfaces of the sample wafers had root-mean-square (RMS) flatness of better than one wavelength (633 nm). Root-mean-square (RMS) surface roughness was between 0.3 and 0.7 nm. After polishing the wafers, the polishing surface 20*a* of the polishing lap 20 appeared unchanged from its initial condition.

EXAMPLE EMBODIMENT 3

Figure 3:
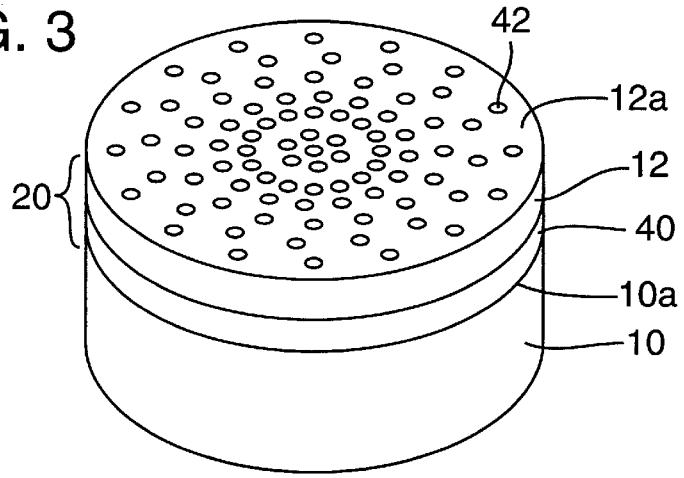
FIG. 3 is a perspective view of a polishing lap according to Example Embodiment 3 comprising a transparent layer and a polishing layer.
Figure 4:
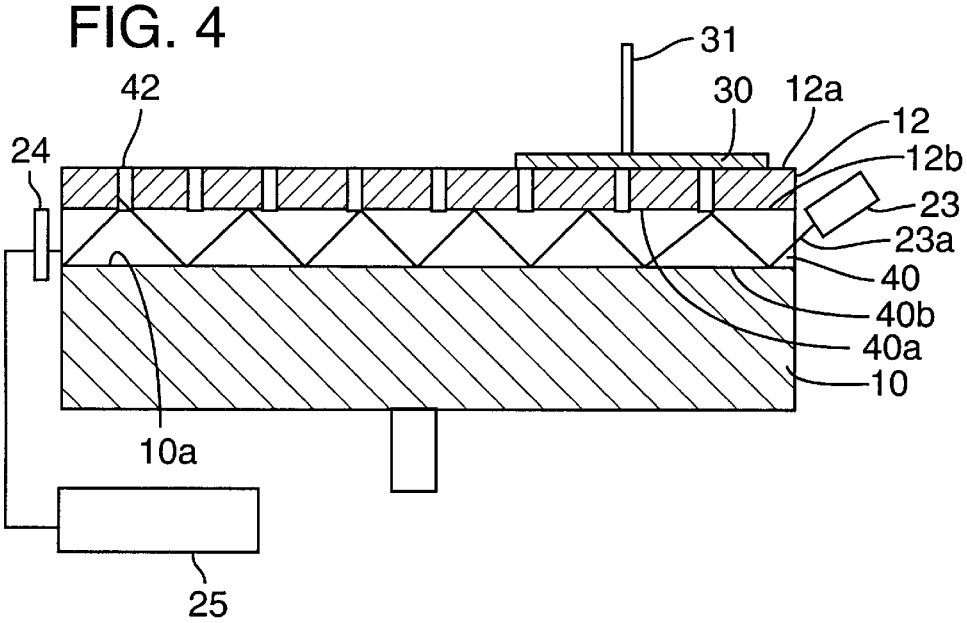
FIG. 4 is an elevational sectional view of a multiple-reflection polish-measuring apparatus according to Example Embodiment 3 for optically assessing the state of polish of a wafer surface.

This example embodiment was directed to a transparent polishing lap 20. With reference to FIG. 3, the polishing lap 20 comprised a transparent layer 40 and a polishing layer 12. A bottom surface of the transparent layer 40 contacted the top surface 10*a* of the polishing wheel 10. The polishing layer 12 was thus situated atop the transparent layer 40. As shown in FIG. 4, the polishing layer 12 had a top surface 12*a* facing the wafer 30 and a bottom surface 12*b* contacting a top surface 40*a* of the transparent layer 40. The polishing layer 12 defined transparent channels 42 extending from the polishing surface 12*a* of the polishing layer 12 down to the transparent layer 40.

In this example embodiment, both layers of the polishing lap 20 were formed using the CMCC process. First, the transparent layer 40 was formed on the polishing wheel 10. The transparent layer 40 comprised the reaction product of an epoxy resin mixture 2 comprising "Bondquick 5" epoxy resin and its curing agent without graphite or glycerine. The thickness of the transparent layer 40 was 10 mm.

After the transparent layer 40 was formed, a polishing layer 12 was formed atop the transparent layer 40 using the CMCC method and the same mixed epoxy resin 2 of Example Embodiment 1. In order to permit light transmission through the polishing lap 20, transparent channels 42 are provided in the polishing layer 12. To make the transparent channels 42, corresponding holes are formed in the polishing layer 12 during casting by providing complementary projections in the compression tool 4. After curing the polishing layer 12, the holes are filled with a similar epoxy resin mixture as used above but without glycerin or graphite powder, and the epoxy resin is cured. Excess epoxy is then removed and the surface 12*a* of the polishing layer 12 grooved and faced.

The resulting polishing lap 20 has the transparent layer 40 bonded to the polishing wheel 10; the transparent layer 40 is covered by the polishing layer 12, with the transparent channels 42 extending from the transparent layer 40 to the polishing surface 12*a* of the polishing layer 12. Thus, both layers 12, 40 of the polishing lap 20 transmit light.

Because the polishing lap 20 of this example embodiment 3 is transparent over part of the surface containing the wafer during polishing, the state of polish of the wafer surface 30*a* can be optically detected during the polishing operation. This permits a wafer 30 to be polished until a desired endpoint is reached. When polishing with a polishing layer according to either Example Embodiment 1 or Example Embodiment 2, in contrast, the wafer 30 is polished under predetermined conditions, previously verified to produce the desired polish on the wafer 30; optical endpoint detection is not available.

FIG. 4 shows a preferred apparatus for monitoring the state of polish of the wafer 30 using a multiple-reflection method. A laser 23 transmits a laser beam 23*a* into the transmissive epoxy layer 40. The laser beam 23*a* enters the light-transmissive layer 40 so that the laser beam 23*a* alternately reflects from the top surface of the polishing wheel 10*a* and from the interface the light-transmissive layer 40 makes with the polishing layer 12. The laser beam 23*a* exits the light-transmissive layer 40 and is detected by a photodetector 24. A controller 25 receives a signal from the photodetector 24 and estimates the state of polish of the wafer 30 based on changes in the light intensity detected by the photodetector 24. The laser 23 and the photodetector 24 rotate with the polishing wheel 10.

In this example embodiment, the state of polish of the wafer 30 is measured using the multiple-reflection method shown in FIG. 4. As shown in FIG. 4, the laser beam 23*a* is multiply reflected between the polishing layer 12 and the top surface 10*a* of the polishing wheel 10. A portion of the laser beam 23*a* enters the transparent channels 42 and reaches the bottom surface 30*b* of the wafer 30. The aluminum layer on the surface of the wafer 30 reflects some of this light back through the transparent channels 42. Thus, the photodetector 24 receives light that has been reflected by the aluminum layer on the wafer 30 as well as some light from multiple reflections from the top surface 40*a* and bottom surfaces 40*b* of the light transmissive layer 40. Light no longer reflects from the aluminum layer when the aluminum layer is completely removed by polishing, so the light detected by the detector 24 decreases rapidly as the aluminum layer is removed. Thus, the controller 25 can assess the state of polish of the wafer 30 by detecting a change in the light received by the detector 24.

Sample wafers (25 count) were polished with the polishing lap 20 of this example embodiment and the state of polish was monitored using the multiple-reflection method. The polished sample wafers had about 2 to 4 interference fringes and a flatness of one wavelength (633 nm). RMS surface roughness was 0.3 to 0.7 nm. The surface of the polishing lap 20 appeared unchanged after polishing all the sample wafers.

It will be apparent that the transparent channels 42 can be made of transparent materials other than epoxy such as glass or fused quartz.

EXAMPLE EMBODIMENT 4

Figure 5:
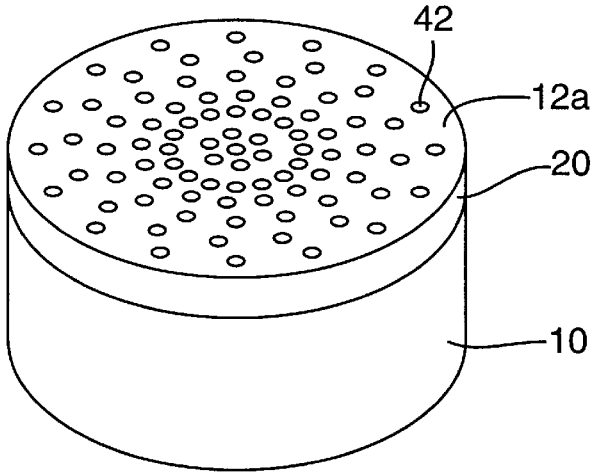
FIG. 5 is a perspective view of a polishing lap with transparent channels according to Example Embodiment 5.

The polishing wheel 10 of this example embodiment 4 is made of a transparent material, fused quartz. (In Example Embodiments 1–3 the polishing wheel 10 can be opaque.) The CMCC method is used to form a polishing lap 20 on the polishing wheel 10 using the epoxy resin mixture 2 of Example Embodiment 1. With reference to FIG. 5, the polishing lap 20 includes transparent channels 42 that transmit light from the top surface 10*a* of the polishing wheel 10 to the bottom surface 30*b* of the wafer 30. Because the polishing wheel 10 is transparent, the transparent layer 40 of Example Embodiment 3 is generally unnecessary. The polishing surface of the polishing lap 20 is cut, grooved, and polished to be flat and smooth.

Figure 6:
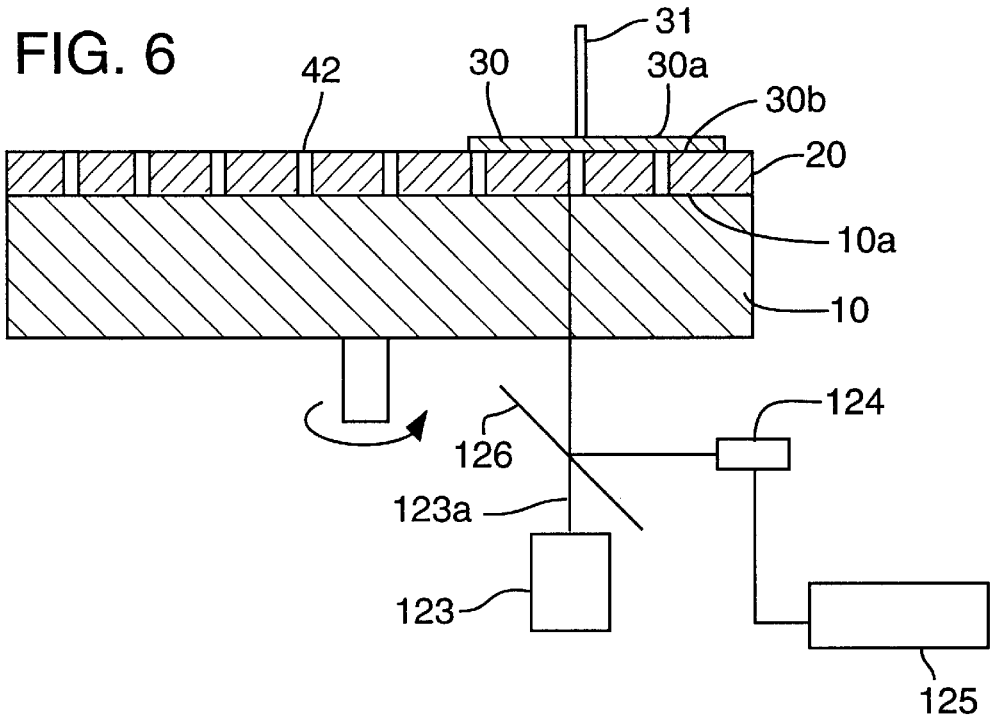
FIG. 6 is an elevational sectional view of a through-beam polish-measuring apparatus according to Example Embodiment 5 for optically assessing the state of polish of a wafer surface.

FIG. 6 shows a state-of-polish detection apparatus using a through-beam method and apparatus. With respect to a through-beam apparatus, a laser 123 emits a laser beam 123*a* that is transmitted by a partially reflecting mirror 126; the portion of the laser beam 123*a* transmitted by the partially reflecting mirror 126 enters the bottom surface of the polishing wheel 10 and is transmitted to the bottom surface of the wafer 30 through the transparent channels 42 of the polishing lap 20. A portion of the laser beam 123*a* is reflected by the wafer 30 back to the partially reflecting mirror 126 and is directed to a photodetector 124. A controller 125 receives a signal from the photodetector 124. The photodetector 124 also receives portions of the laser beam 123*a* reflected by other surfaces.

In the through-beam method, the state of polish of the wafer 30 is assessed as follows. As the metallic layer on the surface of the wafer 30 is removed by polishing, the portion of the laser beam 123*a* reflected to the photodetector 124 decreases. Because even very thin metallic layers have high reflectances, the reflected portion of the laser beam 123*a* decreases rapidly when the metallic layer becomes extremely thin to non-existent. Thus, the controller 125 can determine when the metallic layer is nearly completely polished away by sensing an abrupt decrease in the signal received from the photodetector 124.

Sample wafers (25 count) were polished with the polishing lap 20 of this example embodiment 4. The top surface 30*a* and the bottom surface 30*b* of the polished sample wafers were parallel to within 2 to 4 interference fringes (633 nm). The polished surfaces of the sample wafers had root-mean-square (RMS) flatness of better than one wavelength (633 nm). Root-mean-square (RMS) surface roughness was between 0.3 and 0.7 nm. After polishing the wafers, the polishing surface of the polishing lap 20 appeared unchanged from its initial condition.

Methods to enhance the planar precision of the polishing lap 20 include working the previously described compression tool to high precision and using a replica thereof, breaking in the compression tool using a polishing machine, high-precision cutting of the compression tool using an ultra-precision lathe such as an ultra-precision numerically-controlled (NC) machine tool.

It will be apparent that the polishing surface need not be formed directly on the polishing lap 20. Instead, the polishing surface can be prepared on another surface subsequently transferred and bonded to the polishing wheel 10 using, e.g., a rubber adhesive, a cyanoacrylate adhesive, or a double-faced adhesive film.

EXAMPLE EMBODIMENT 5

In this example embodiment, a polishing lap 20 was prepared by mixing "Bondquick 5" epoxy resin, a curing agent, glycerin, and nylon powder (Toray Nylon Powder SP-500) in a ratio of 3:1:1:0.05 by weight and following the CMCC method of FIG. 2. The polishing wheel 10 can be either cast iron or fused quartz. The thickness of the epoxy resin mixture 2 was 3 mm. The epoxy resin mixture 2 was cured for one hour at 70° C. Radial grooves were machined in the surface of the polishing lap 20.

Various methods can be used to face the polishing lap 20. One method involves using an ultra-high-precision lathe; the surface roughness of the polishing surface of the polishing lap can be thus made less than 1 $\mu$m.

In this example embodiment, the polishing lap 20 was faced by polishing the polishing lap with 5% cerium oxide and a 300 mm diameter polishing plate.

The polishing lap 20 of this example embodiment was used to polish a set of 25 sample wafers. Polishing conditions are summarized in Table 2.

TABLE 2

| Polishing Conditions | |
|---|---|
| polishing wheel rotation | 250 rpm |
| wafer sliding distance | 15 mm |
| wafer sliding rate | 45 cycles/minute |

TABLE 2-continued

| Polishing Conditions | |
|---|---|
| load | 190 g/cm$^2$ |
| polishing slurry | 5% cerium oxide |
| polishing time | 1 minute |

The sample wafers polished with the polishing lap of this example embodiment were flat to within 2 to 4 interference fringes. The sample wafers showed no edge wear or flatness errors caused by patterns on the sample wafers. The polishing surface of the polishing the wafers lap 20 appeared unchanged after polishing and required no additional preparation between wafers to continue wafer polishing.

EXAMPLE EMBODIMENT 6

The polishing lap 20 of this example embodiment was prepared from a mixture of "Bondquick 5" epoxy resin, tetraethylenepentamine curing agent, glycerin, and nylon powder (Toray SP-500) in a ratio of 3:1:0.5:0.05 by weight using the CMCC method. The polishing wheel 10 was cast iron and a spiral groove was cut into the polishing lap 20.

Sample wafers (25 count) polished using the polishing lap 20 of this example embodiment were flat to within 2 to 4 interference fringes (633 nm). The sample wafers showed no edge wear or flatness errors caused by patterns on the sample wafers. The polishing surface of the polishing lap 20 appeared unchanged after polishing the wafers and required no additional preparation to continue wafer polishing.

EXAMPLE EMBODIMENT 7

In this example embodiment, a polishing lap 20 according to Example Embodiment 5 was formed on a cast-iron polishing wheel 10 as described above. Sample wafers (25 count) were polished under the polishing conditions of Example Embodiment 5. In this example embodiment, however, the state of polish of the surfaces of the wafers was actively monitored during polishing.

Each of the polished wafers had a surface quality similar to those polished in the previous example embodiments. The polishing lap was inspected after polishing the wafers and no change was observed in the polishing lap.

Figure 7:
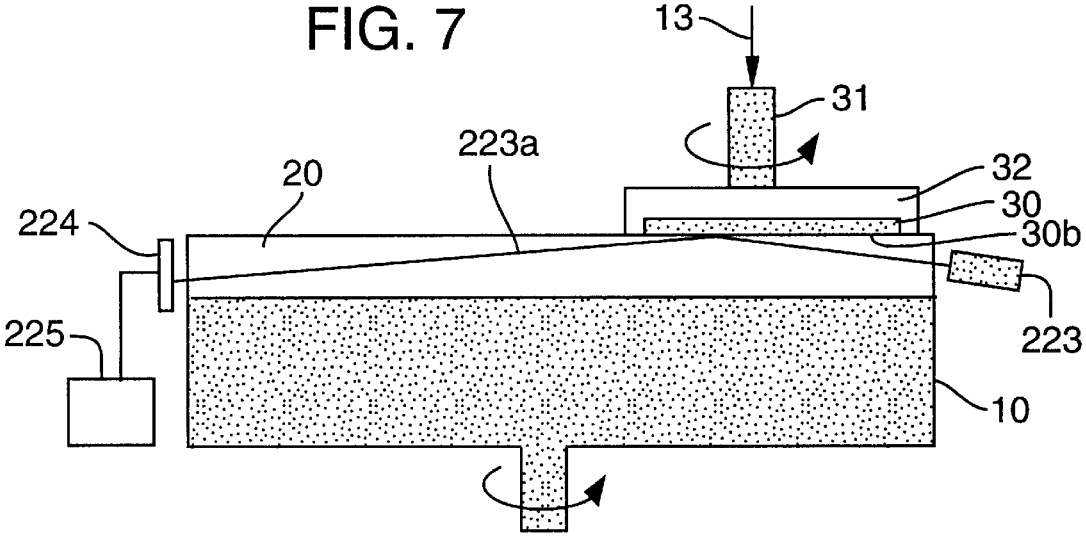
FIG. 7 is an elevational sectional view of a single-reflection polish-measuring apparatus according to Example Embodiment 7 for optically assessing the state of polish of a wafer surface.

As used in this example embodiment, a single-reflection system for observing the state of polish of a wafer 30 is shown in FIG. 7. A laser 223 emits a laser beam 223*a* into the polishing lap 20. The laser beam 223*a* reflects from the bottom surface 30*b* of the wafer 30 and is directed to a photodetector 224 positioned radially opposite the laser 223. The laser 223 and the photodetector 224 are attached so as to rotate together with the polishing lap 20 and polishing wheel 10.

The state of polish of the wafer 30 was assessed by observing the magnitude of the portion of the laser beam 223*a* reaching the photodetector 224. As the metallic layer on the bottom surface 30*b* of the wafer 30 was removed, the reflected portion of the laser beam 23*a* rapidly decreased. A controller 225 received a signal from the photodetector 224 and detected the polishing end point. In this way, a polishing endpoint was readily established based on the reflectance of the bottom surface 30*a* of the wafer 30, and the extent of polishing was easily controlled.

EXAMPLE EMBODIMENT 8

In this example embodiment, the polishing wheel 10 was made of transparent fused quartz onto which the polishing lap 10 of Example Embodiment 5 was formed using the CMCC method. The same mixture of epoxy resin, curing agent, glycerin, and nylon powder was used as in Example Embodiment 5. As in Example Embodiment 5, the polishing lap was grooved by machining and faced by polishing. Sample wafers (25 count) were polished using the CMP method and using optical endpoint detection. Similar polish quality was obtained on the wafers as in the previous example embodiments. After polishing all the wafers, the polishing lap 20 appeared unchanged and required no additional processing.

The through-beam method of determining the polishing endpoint as shown in FIG. 7 was used in this example embodiment. When the aluminum layer on the surface of the wafer 30 was nearly completely removed, the amount of reflected light became abruptly smaller; the magnitude of the reflected light also oscillated. The controller 225 used the changes in reflectance to detect the polishing end point.

EXAMPLE EMBODIMENTS 9–12

Figure 8:
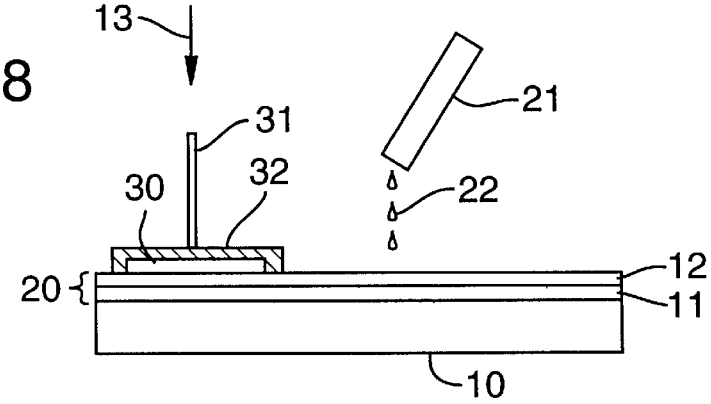
FIG. 8 is an elevational view of a polishing lap according to Example Embodiments 9–11 comprising an elastic layer and a polishing layer.

In Example Embodiments 9–11, a two-layer structure was used for the polishing lap 20. With reference to FIG. 8, the polishing lap 20 comprised an elastic layer 11 formed directly on the polishing wheel 10 and a polishing layer 12 formed on top of the elastic layer 11. In Example Embodiments 9–11, the elastic layer 11 was formed of FEX-0101 epoxy resin main agent (Yokohama Rubber) and tetraethylenepentamine curing agent combined in a ratio of 10:1 (v/v) and cured in place on the polishing wheel 10 at a temperature of 50° C. for 3 hours. The elastic layer 11 of Example Embodiments 9–11 was 10 mm thick and had an Asker-C hardness of 65.

The elastic-body layer can be bonded to the polishing wheel using a bonding material. Examples of bonding materials that can be used are various adhesives, such as rubber adhesives and cyanoacrylate adhesives, or tape-bonding members such as double-faced tape.

EXAMPLE EMBODIMENT 9

The polishing layer 12 of this example embodiment was formed from a resin mixture consisting of "Bondquick 5" epoxy resin, a curing agent, glycerin, and nylon powder (Toray SP-500) in proportions of 3:1:1:0.05 by weight using the CMCC method of FIG. 2. The polishing layer 12 was formed on top of the elastic layer 11. The polishing wheel 10 was cast iron or fused quartz. The thickness of the polishing layer 12 was 3 mm. The resin mixture was cured for 3 hours at a temperature of 50° C. After curing, grooves were machined into the polishing layer 12 in the cross-hatch pattern of FIG. 9(*a*). The polishing layer 12 had a hardness of 95 on the Asker-C scale.

The polishing layer 12 was faced by polishing with a 300 mm diameter polishing plate and a 5% by weight cerium oxide polishing slurry using an Oscar-type polishing machine. The surface roughness of the finished surface of polishing layer 12 was approximately 1 $\mu$m.

The polishing lap 20 of this example embodiment was used to polish a series of identical test wafers (25 count) using the polishing conditions shown in Table 3.

TABLE 3

| Polishing Conditions | |
|---|---|
| polishing wheel rotation | 45 rpm |
| wafer sliding distance | 35 mm |
| wafer sliding frequency | 25 cycles/minute |
| load | 190 g/cm$^2$ |
| polishing slurry | 6% cerium oxide |
| polishing time | 1 minute |

The polished sample wafers were flat to within 2 to 4 interference fringes (633 nm). There were no effects of edge wear or flatness caused by pattern density. The polishing lap 20 appeared unchanged after polishing the wafers and dressing was not necessary. A conventional polishing pad would require dressing after such use.

EXAMPLE EMBODIMENT 10

Figure 9A:
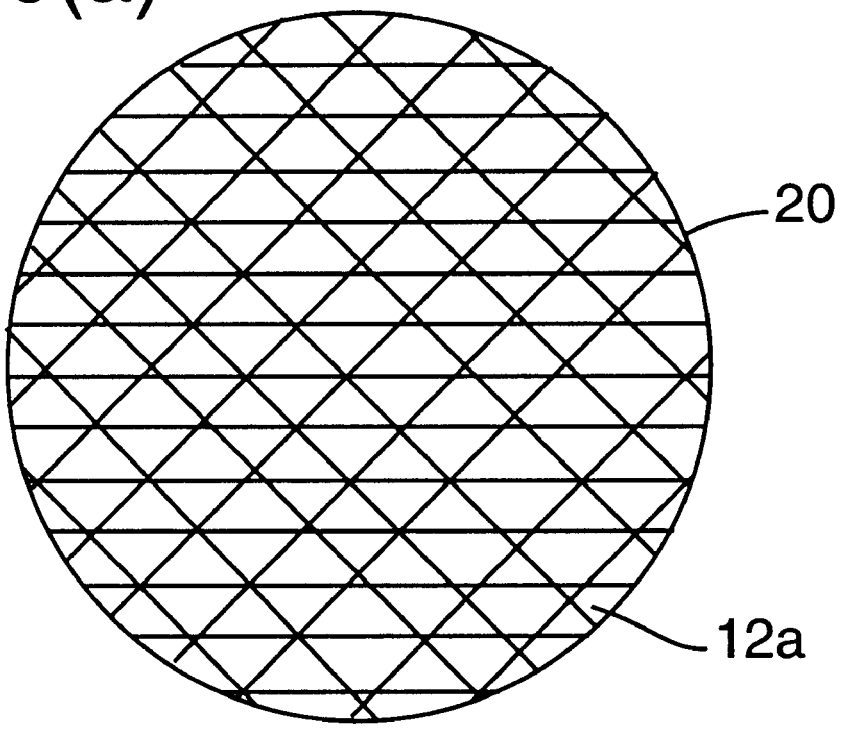
FIG. 9(*a*) shows a cross-hatch groove pattern for a polishing lap according to Example Embodiment 9.
Figure 9B:
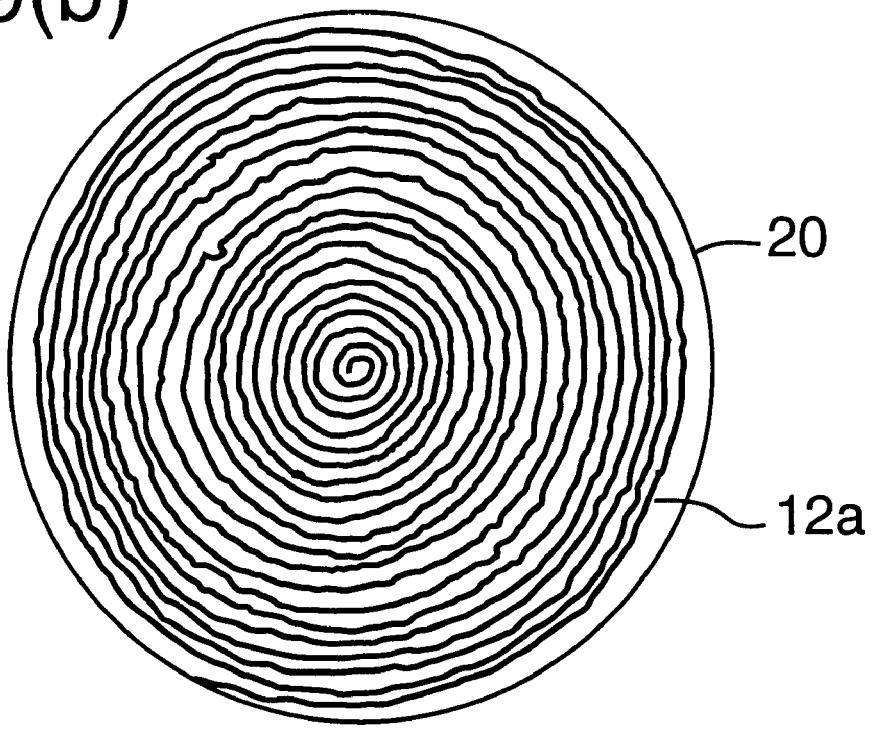

In this example embodiment 10 a polishing lap 20 was formed with an epoxy resin mixture comprising "Bondquick 5" epoxy resin, tetraethylenepentamine curing agent, glycerin, and carbon powder in a mix ratio of 3:1:0.5:0.05 by weight. The hardness of the polishing layer 20 was 95 on the Asker-C scale. A spiral groove as shown in FIG. 9(*b*) was cut into the polishing surface 12*a*. Otherwise, this example embodiment was identical to Example Embodiment 9.

Two hundred sample wafers were polished using the polishing lap of this example embodiment 10 using the polishing conditions of Example Embodiment 9. The surface quality achieved on each wafer was excellent. RMS surface roughness was 0.3 nm to 0.7 nm. After polishing, the polishing layer 12 appeared unchanged and dressing was unnecessary.

EXAMPLE EMBODIMENT 11

The polishing lap 20 of this example embodiment 11 comprised a polishing pad (IC-1000 made by Roder-Nitta) as the polishing layer 12 on top of an elastic layer 11. The hardness of the polishing lap 20 was 95 on the Asker-C scale.

Two hundred sample wafers were polished with the polishing lap 20 of this example embodiment using the polish conditions of Example Embodiment 9 which produced a smooth, flat polishing. RMS surface roughness was 0.3 nm to 0.9 nm. In this example embodiment, a dressing or grinding process was performed on the polishing lap after each wafer was polished; a diamond polishing mixture was used for this dressing process.

EXAMPLE EMBODIMENT 12

In this example embodiment 12 the polishing wheel 10 was made of silicon. Silicon is advantageous because it transmits infrared light; other materials that transmit infrared light can also be used, e.g., glass and fused quartz.

The polishing lap 20 of this example, embodiment 12 was made using an epoxy resin mixture comprising an epoxy resin with an amine or tetraethylenepentamine curing agent, and graphite, mixed in the ratio X:1:1/150 where X is between 3 and 7. The hardness of the polishing lap was in the range 60–130 on the Rockwell C scale. The hardness of the polishing lap 20 corresponded to the hardness of the wafer to be polished; hardness was readily adjusted by altering the mix ratio of the epoxy resin mixture 2 or the curing conditions of the epoxy resin mixture.

Figure 10:
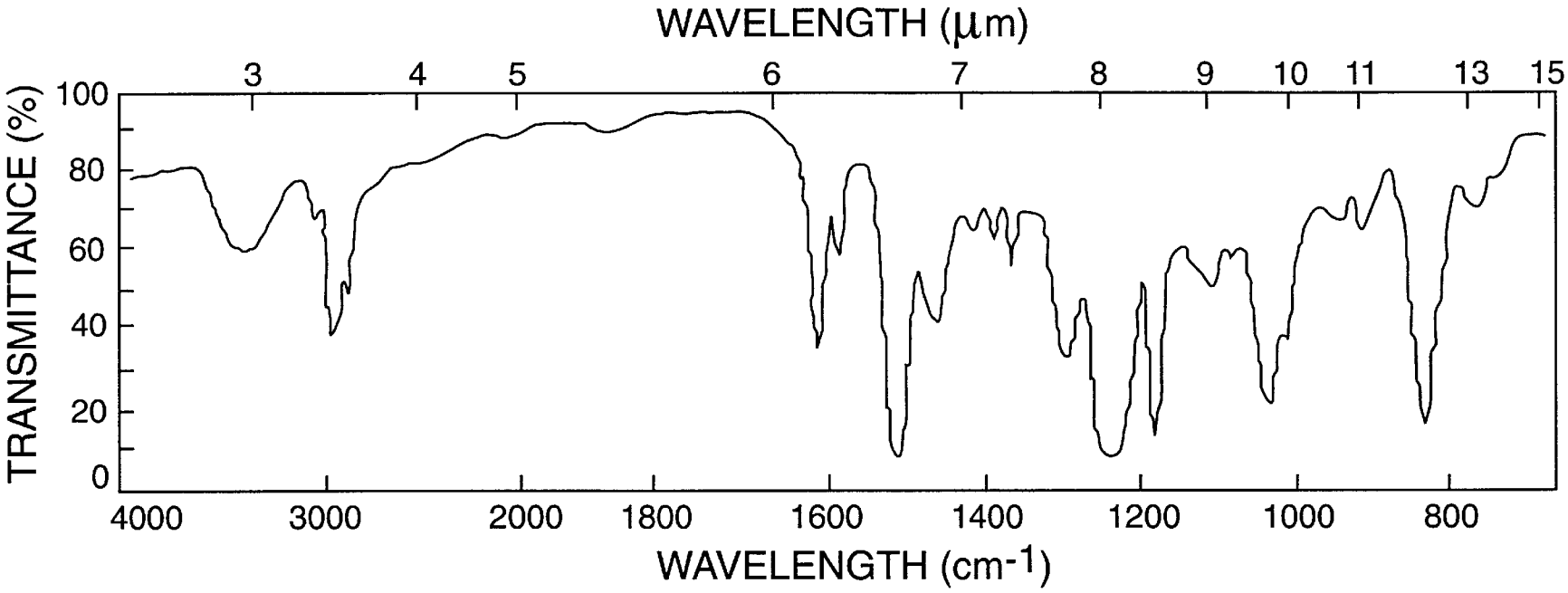
FIG. 10 is a graph showing transmittance of a mixed epoxy resin as a function of wavelength (Example Embodiment 12).

The polishing lap 20 transmitted infrared light. FIG. 10 shows the transmittance of the polishing lap 20 as a function of wave number. With reference to FIG. 10 it is readily apparent that infrared light of wavelength between 4 $\mu$m and 6 $\mu$m is transmitted with little attenuation. The polishing lap 20 of this example embodiment also transmitted near-infrared light of wavelengths between 1 $\mu$m and 2.5 $\mu$m.

Figure 11:
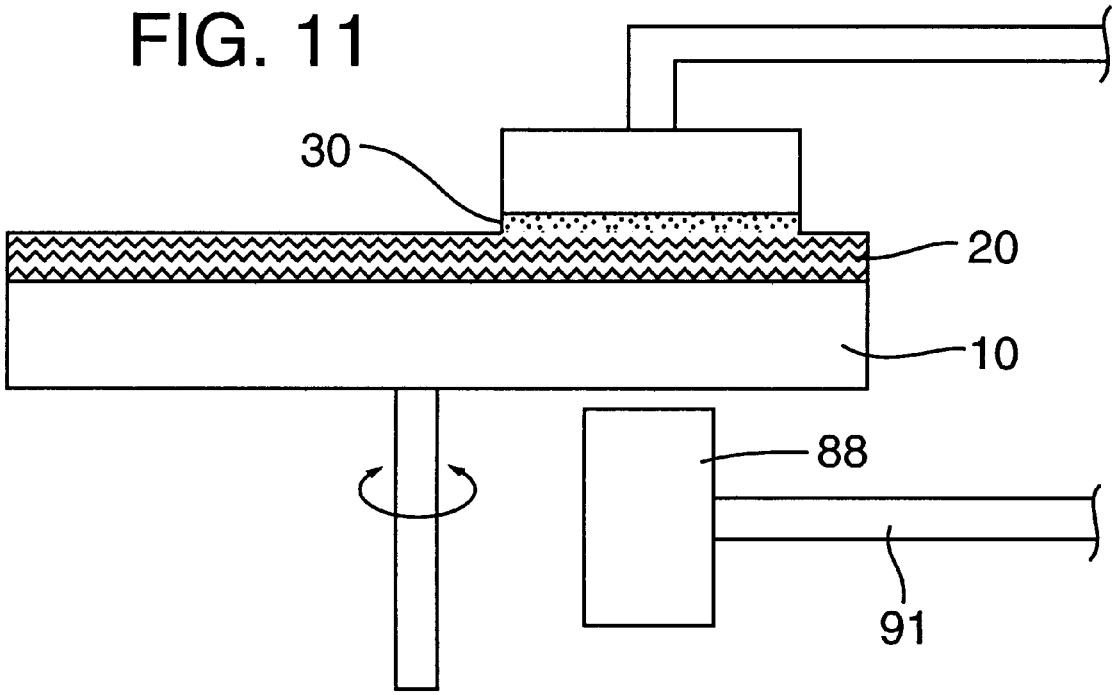
FIG. 11 shows a polishing apparatus with an infrared optical polish monitor (Example Embodiment 12).
Figure 12:
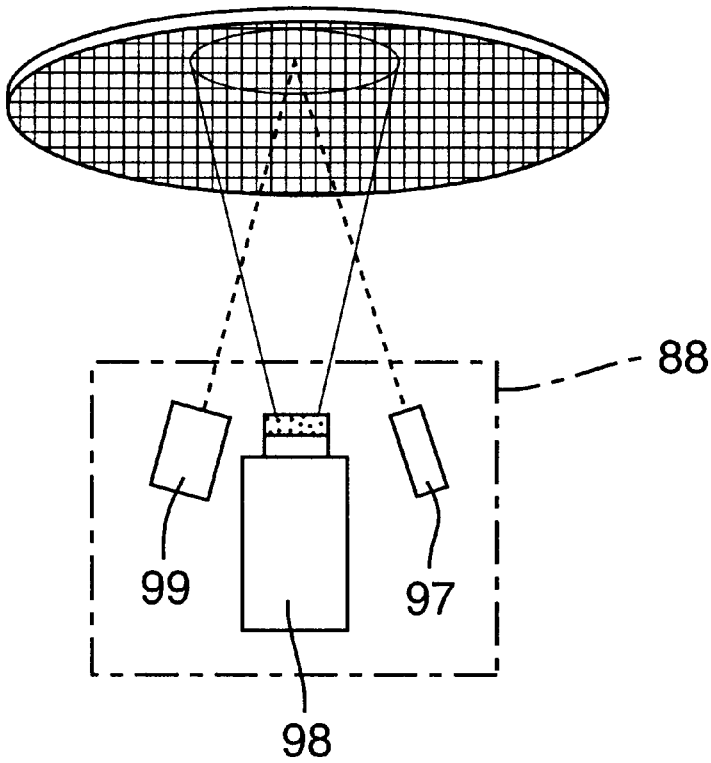
FIG. 12 shows the infrared optical polish monitor of FIG. 10, showing an infrared illuminator, an infrared imaging apparatus, and an infrared film-thickness monitor (Example Embodiment 12).

Optical endpoint detection using this example embodiment was satisfactory because the polishing lap 20 and the polishing wheel 10 were transparent to infrared light. With reference to FIGS. 11–12, a polish-measurement apparatus 88 was situated beneath the polishing wheel 10 and the polishing lap 20 by a holder 91. The polish-measuring apparatus 88 comprised a film-thickness-measurement apparatus 99. The film-thickness-measurement apparatus 99 measured the thickness of films on the bottom surface 30*b* of the wafer 30. The polish-measuring apparatus 80 further comprised an infrared imaging device 98 and an infrared illuminator 97. The infrared imaging device 98 imaged the bottom surface 30*b* of the wafer 30 while the wafer 30 was mounted in the polishing apparatus.

The film thickness unit 99 and the infrared imaging device 98 performed measurements and observations using infrared light that passed through the polishing wheel 10 and the polishing lap 20. The film-thickness measurement apparatus 99 was a spectral ellipsometer that analyzed polarized light reflection from the bottom surface 30*b* of the wafer 30. (Alternatively, the film-thickness-measurement apparatus 99 can be an interferometer.)

During polishing, the thickness of the aluminum film on the bottom surface 30*b* of the wafer 30 was measured by the film-thickness measurement apparatus 99. In addition, the bottom surface 30*b* of the wafer 30 was imaged by the infrared imaging device 98.

The thickness of the polishing surface of wafer 30 was measured by emitting infrared rays from the infrared illuminator 97 and causing them to pass through the polishing lap 20 to thereby irradiate the surface of the wafer 30. Reflected light from the wafer 30 was incident upon the film-thickness-measurement apparatus 99.

In general, a solid object radiates infrared rays according to its temperature. In this embodiment the polishing surface of wafer 30 emitted infrared rays according to the local temperature on the wafer 30. The infrared rays emitted from the surface of the wafer 30 were transmitted through the polishing lap 20 and the polishing wheel 10 to be incident upon the infrared imaging device 98. Thus, a thermal image of the surface of the wafer 30 was observed. It is not necessary to provide a special light source for such observation.

The infrared-transmitting polishing wheel 10 and polishing lap 20 enabled infrared optical film-thickness measurements to be made. Unlike the conventional methods, it was unnecessary for the polishing lap 20 to have an opening. As a result, a better polish was realized on the bottom surface 30*a* of the wafer 30 than achievable using conventional methods and apparatus.

Because the epoxy resin that comprised the polishing lap 20 had low shrinkage and was readily molded and cut, the polishing surface 20*a* of the polishing lap 20 was flat and smooth. The flatness and smoothness of the polishing surface of the polishing lap 20 had a direct effect on the state of polish achievable with the wafer 30.

EXAMPLE EMBODIMENT 13

Figure 13:
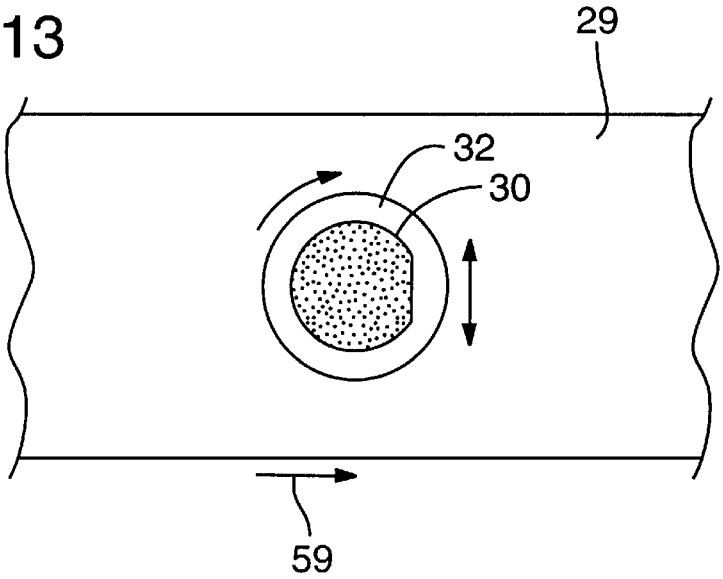
FIG. 13 shows a polishing belt according to Example Embodiment 13 for polishing a wafer.
Figure 15A:
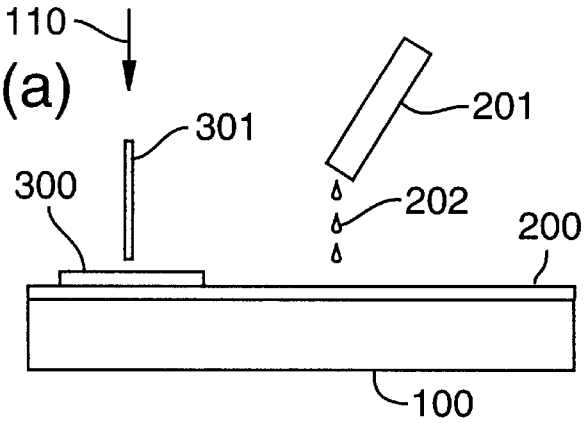
FIG. 15(*a*) shows a conventional semiconductor-polishing apparatus that uses the CMP technique.
Figure 15B:
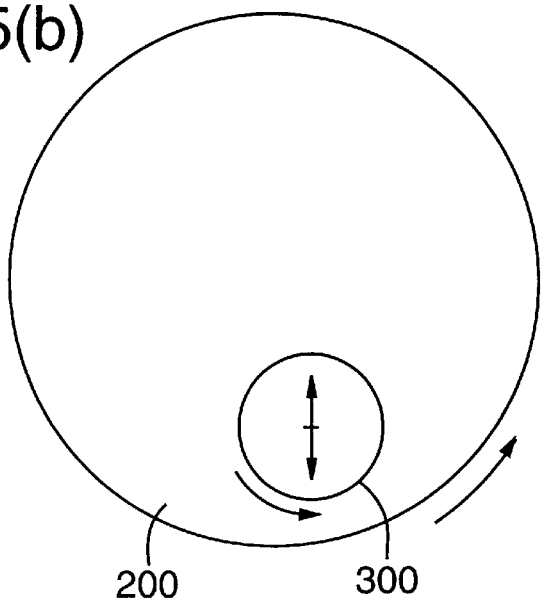

FIG. 13 shows a polishing belt 29 according to this example embodiment 13. The polishing belt 29 is used instead of the polishing wheels 10 of Example Embodiments 1–12. With reference to FIG. 13, the polishing belt 29 moves linearly with respect to the wafer 30 as shown by an arrow 59.

The polishing belt 29 is made of a suitable material that transmits infrared light. For example, the polishing belt 29 can be made from a mixed epoxy resin comprising graphite, an epoxy resin, and an amine or tetraethylenepentamine curing agent. Because the polishing belt 29 transmits infrared light, the state of polish can be optically detected without a hole in the polishing belt 29.

Other possible materials are silicon, glass, or fused quartz, but this example embodiment is not limited to belts made of such materials.

As is apparent, the various embodiments of polishing laps of the invention have numerous benefits. First, wafer edge wear is controlled. Second, the polishing laps do not deform even when under pressure. Third, because the polishing laps are integrally bonded to the polishing wheel, particles and other defects at the boundary are avoided. Fourth, the polishing lap does not require dressing or grinding during use (between wafers for example). Fifth, wafer surfaces are better and more precisely polished. Sixth, optical endpoint detection is possible without having to provide holes in the polishing wheel and lap. Seventh, the thermal deformation of the polishing laps is reduced. In addition, these polishing laps exhibit reduced friction with the wafer surface and thus perform wafer polishing with little heat generation. Lastly, these polishing laps are inexpensive and can polish many surfaces without wear.

Having illustrated and demonstrated the principles of the invention in example embodiments, it should be apparent to those skilled in the art that the preferred embodiment can be modified in arrangement and detail without departing from such principles. We claim as the invention all that comes within the scope of these claims.

What is claimed is:

1. A polishing lap for polishing a surface of a semiconductor wafer, comprising a cured mixture of an epoxy resin, a curing agent, a lubricant, and a filler.

2. The polishing lap of claim 1, wherein the filler is selected from a group consisting of graphite, carbon particles, and nylon.

3. The polishing lap of claim 1, wherein the polishing lap comprises a second layer superposed on a first layer, the second layer having a major surface that contacts the surface of the wafer during use for polishing the wafer.

4. The polishing lap of claim 3, wherein the first layer is an elastic layer.

5. The polishing lap of claim 3, wherein the first layer is a transparent layer.

6. The polishing lap of claim 5, wherein the second layer comprises transparent channels extending from the transparent layer to the surface at which the substrate is polished.

7. The polishing lap of claim 1, configured as a layer attached to a polishing wheel.

8. The polishing lap of claim 1, configured as a second layer superposedly attached to a transparent first layer.

9. The polishing lap of claim 8, further comprising a polishing wheel, the transparent layer being bonded to the polishing wheel.

10. The polishing lap of claim 1, wherein the lubricant is a polyol.

11. The polishing lap of claim 10, wherein the polyol is glycerin.

12. An apparatus for polishing a working surface of a semiconductor wafer, comprising:

(a) a polishing wheel adapted to undergo a movement relative to the wafer; and (b) a polishing lap attached to an upper major surface of the polishing wheel, the polishing lap having a first major surface that contacts the working surface during use of the polishing lap for polishing the working surface, the polishing lap comprising a material formed from a cured mixture of an epoxy resin, a curing agent for the epoxy resin, glycerin, and a particulate carbon selected from a group consisting of carbon whiskers, graphite powder, and mixtures thereof.

13. The apparatus of claim 12, wherein the polishing lap comprises a light-transmitting portion extending through a thickness dimension of the polishing lap, the light-transmitting portion being transmissive to either visible light or infrared light, or both.

14. The apparatus of claim 13, wherein the polishing wheel is formed of a substance that is opaque to the light, the apparatus further comprising a layer of a substance that is transparent to the light, the layer being sandwiched between the polishing wheel and the polishing lap.

15. The apparatus of claim 13, wherein the polishing wheel is formed of a substance that is transparent to the light.

16. The apparatus of claim 13, further comprising:

(a) a light source for directing a beam of the light at the light-transmitting substance such that the light can pass through the light-transmitting substance and reflect from a surface of the wafer;

(b) a detector sensitive to the light for receiving light, directed to the wafer from the light source, reflecting from the surface of the wafer; and (c) a processor connected to the detector, the processor being operable to determine the polishing condition of the wafer, during polishing, based on changes in light reflecting from the wafer and received by the detector.

17. A CMP polishing apparatus for polishing a working surface of a planar workpiece, the apparatus comprising:

(a) a polishing wheel having a major surface; and (b) a polishing lap adapted to contact the working surface so as to polish and improve planar characteristics of the working surface, the polishing lap being formed of a cured mixture of an epoxy resin and an additive comprising nylon powder, the polishing lap being formed directly on the major surface of the polishing wheel or bonded to the major surface using an adhesive.

18. The CMP polishing apparatus of claim 17, wherein the additive further includes glycerin.

19. The CMP polishing apparatus of claim 17, wherein the polishing wheel is formed of a substance opaque to light and the polishing lap includes a region that is transmissive to the light, the apparatus further comprising a light emitter operable to emit a beam of light toward and into the light-transmissive region of the polishing lap so as to reflect from the working surface, a light receiver operable to detect light reflected from the working surface and passing through the light-transmissive region of the polishing lap, and a processor connected to the light receiver and operable to ascertain a polishing status of the working surface based on changes in the reflected light detected by the light receiver.

20. The CMP polishing apparatus of claim 17, wherein the polishing wheel is formed of a substance that is transmissive to the light and the polishing lap includes a region that is transmissive to the light, the apparatus further comprising a light emitter operable to emit a beam of light through the polishing wheel and into the light-transmissive region of the polishing lap so as to reflect from the working surface, a light receiver operable to detect light reflected from the working surface and passing through the light-transmissive region of the polishing lap and through the polishing wheel, and a processor connected to the light receiver and operable to ascertain a polishing status of the working surface based on changes in the reflected light detected by the light receiver.

21. A CMP polishing apparatus for polishing a working surface of a planar workpiece, the apparatus comprising:

(a) a polishing wheel having a major surface;

(b) a rigid polishing lap adapted to contact the working surface so as to polish and improve planar characteristics of the working surface, the polishing lap being formed of a cured mixture comprising a first epoxy resin, the polishing lap being mounted to the major surface of the polishing wheel; and (c) an elastic layer, having a hardness less than the polishing lap, sandwiched between the polishing lap and the major surface of the polishing wheel.

22. The CMP polishing apparatus of claim 21, wherein the elastic layer has a hardness of 60 to 90 on an Asker-C scale.

23. The CMP polishing apparatus of claim 21, wherein the elastic layer comprises a cured mixture comprising a second epoxy resin.

24. The CMP polishing apparatus of claim 21, wherein the polishing lap has a hardness of at least 60 on an Asker-C scale.

25. The CMP polishing apparatus of claim 21, wherein the cured mixture from which the polishing lap was formed further comprises an additive selected from a group consisting of carbon powder, carbon fiber, nylon powder, glycerin, and mixtures thereof.

26. The CMP polishing apparatus of claim 21, wherein the polishing wheel is formed of a material that is opaque to light and the polishing lap comprises a portion that is transparent to light.

27. The CMP polishing apparatus of claim 26, further comprising:

a light source operable to direct a beam of light toward the transparent portion of the polishing lap to allow the light beam to enter the transparent portion and reflect from the working surface, a light detector situated so as to receive a light beam reflected from the working surface, and a controller connected to the light detector for ascertaining, from the received light, a polishing status of the working surface as the working surface is being polished by the polishing lap, and for detecting from the polishing status a polishing end point of the working surface.

28. The CMP polishing apparatus of claim 21, wherein the polishing wheel and polishing lap are transparent to light, the apparatus further comprising:

a light source operable to direct a beam of light toward the transparent portion of the polishing lap to allow the light beam to enter the transparent portion and reflect from the working surface, a light detector situated so as to receive a light beam reflected from the working surface, and a controller connected to the light detector for ascertaining, from the received light, a polishing status of the working surface as the working surface is being polished by the polishing lap, and for detecting from the polishing status a polishing end point of the working surface.

29. An apparatus for planarizing and polishing a working surface of a flat workpiece, the apparatus comprising:

(a) a polishing wheel;

(b) a polishing lap attached to the polishing wheel and adapted to undergo relative motion with the workpiece, the polishing lap having a first major surface that contacts the working surface of the workpiece during use of the polishing lap for polishing the working surface, the polishing lap being adapted to transmit light incident on the polishing lap, wherein the polishing lap is transmissive to infrared light having a wavelength of 4 to 6 $\mu$m;

(c) a light source adapted to cause light to be incident on the polishing lap as the working surface is being polished by the polishing lap, the light being visible light, infrared light, or a mixture of visible and infrared light; and (d) a light detector directed so as to receive, as the working surface is being polished by the polishing lap, light passing through the polishing lap and reflecting from the workpiece, wherein the amount of light received by the light detector is a function of a characteristic of the working surface.

30. The apparatus of claim 29, wherein the light source is situated relative to the polishing lap so as to direct the light at a second major surface of the polishing lap, opposite the first major surface, wherein the light from the light source passes through a thickness dimension of the polishing lap to the working surface.

31. The apparatus of claim 29, further comprising a rotary polishing wheel to which a second major surface of the polishing lap, opposite the first major surface, is bonded, the polishing wheel and polishing lap being formed of a material that transmits the light.

32. An apparatus for planarizing and polishing a working surface of a workpiece, the apparatus comprising:

(a) a polishing lap adapted to undergo relative motion with the workpiece, the polishing lap having a first major surface that contacts the working surface of the workpiece during use of the polishing lap for polishing the working surface, the polishing lap being adapted to transmit light incident on the polishing lap and configured as a belt operable to contact the working surface and to move linearly relative to the workpiece, the belt comprising a material that transmits the light;

(b) a light source adapted to cause light to be incident on the polishing lap as the working surface is being polished by the polishing lap, the light being visible light, infrared light, or a mixture of visible and infrared light; and (c) a light detector directed so as to receive, as the working surface is being polished by the polishing lap, light passing through the polishing lap and reflecting from the workpiece, wherein an amount of the light received by the light detector is a function of a characteristic of the working surface.

33. An apparatus for planarizing and polishing a working surface of a workpiece, the apparatus comprising:

(a) a polishing wheel;

(b) a polishing lap attached to the polishing wheel and adapted to undergo relative motion with the workpiece, the polishing lap having a first major surface that contacts the working surface of the workpiece during use of the polishing lap for polishing the working surface, the polishing lap being adapted to transmit light incident on the polishing lap and comprising a cured mixture of an epoxy resin, an amine curing agent for the epoxy resin, and graphite;

(c) a light source adapted to cause light to be incident on the polishing lap as the working surface is being polished by the polishing lap, the light being visible light, infrared light, or a mixture of visible and infrared light; and (d) a light detector directed so as to receive, as the working surface is being polished by the polishing lap, light passing through the polishing lap and reflecting from the workpiece, wherein an amount of the light received by the light detector is a function of a characteristic of the working surface.

34. An apparatus for planarizing and polishing a working surface of a workpiece, the apparatus comprising:

(a) a polishing wheel;

(b) a polishing lap attached to the polishing wheel and adapted to undergo relative motion with the workpiece, the polishing lap having a first major surface that contacts the working surface of the workpiece during use of the polishing lap for polishing the working surface, the polishing lap being adapted to transmit light incident on the polishing lap;

(c) a light source adapted to cause light to be incident on the polishing lap as the working surface is being polished by the polishing lap and situated relative to the polishing lap so as to direct the light at a radial edge of the polishing lap, the light being visible light, infrared light, or a mixture of visible and infrared light; and (d) a light detector situated radially opposite the light source so as to receive, as the working surface is being polished by the polishing lap, light passing through the polishing lap and reflecting from the workpiece, wherein an amount of the light received by the light detector is a function of a characteristic of the working surface.

* * * * *

UNITED STATES PATENT AND TRADEMARK OFFICE

CERTIFICATE OF CORRECTION

PATENT NO. : 6,074,287
DATED : June 13, 2000
INVENTOR(S) : Miyaji, et. al.

It is certified that error appears in the above-identified patent and that said Letters Patent is hereby corrected as shown below:

Col. 1, line 65, "$SiO_2$))," should read -- $SiO_2$), --.

Figures 14A, 14B, 14C:
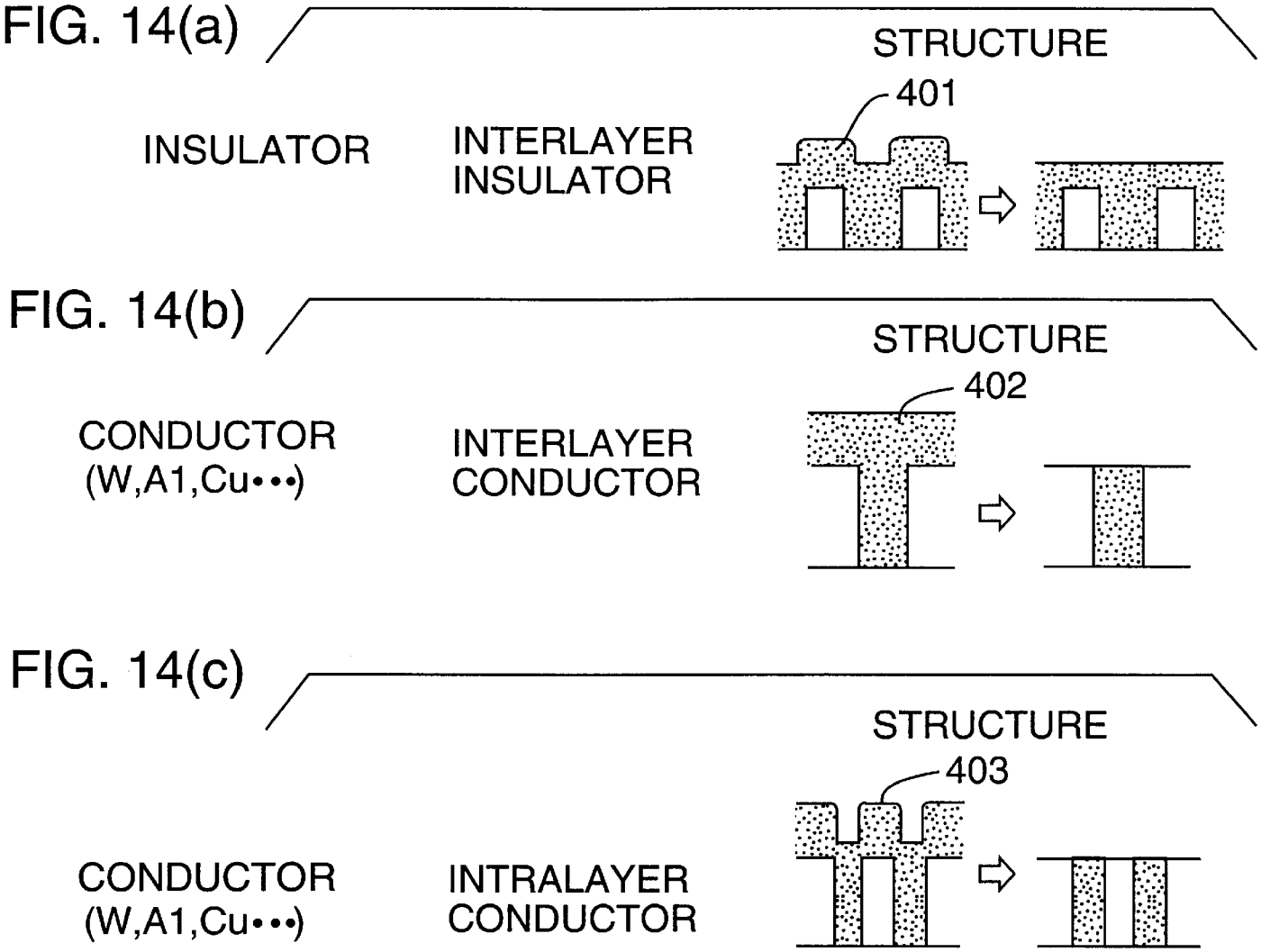
FIGS. 14(*a*)–14(*c*) show the effect of wafer-processing operations on the surface of a wafer and the planarization of the wafer by subsequent polishing.

Col. 2, line 6, "FIGS. 14(a) – (c)" should read – FIGS. 14(a) -- 14(c) --.

Col. 8, lines 44-45, "layer 12 grooved and faced" should read -- layer 12 is grooved and faced --.

Col. 11, line 13, "polishing the wafers lap" should read -- polishing lap --.

Col. 12, line 23, "EXAMPLE EMBODIMENTS 9-12" should read – EXAMPLE EMBODIMENTS 9-11"

Col. 13, line 44, "polish conditions" should read -- polishing conditions --.

Col. 13, line 45, "flat polishing." should read -- flat polish. --.

Col. 14, line 30, "film-thickness measurement" should read -- film-thickness-measurement --.

<u>In the Claims</u>:

Col. 16, line 23, "beam of the light" should read -- beam of light --.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*